US008702330B2

(12) United States Patent
Inoue

(10) Patent No.: US 8,702,330 B2
(45) Date of Patent: Apr. 22, 2014

(54) ROLL PAPER PRINTER AND METHOD OF OPENING AND CLOSING A ROLL PAPER PRINTER COVER

(75) Inventor: Nobuhiro Inoue, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 285 days.

(21) Appl. No.: 13/072,894

(22) Filed: Mar. 28, 2011

(65) Prior Publication Data

US 2011/0236115 A1 Sep. 29, 2011

(30) Foreign Application Priority Data

Mar. 29, 2010 (JP) ..... 2010-075002

(51) Int. Cl.
*B41J 15/04* (2006.01)
*B41J 29/13* (2006.01)

(52) U.S. Cl.
CPC ..... *B41J 15/042* (2013.01); *B41J 15/04* (2013.01); *B41J 29/13* (2013.01)
USPC ..... 400/613; 400/693

(58) Field of Classification Search
CPC ..... B41J 15/042; B41J 19/10; B41J 19/12; B41J 19/1863
USPC ..... 400/613, 693
See application file for complete search history.

(56) References Cited

U.S. PATENT DOCUMENTS 5,230,576 A * 7/1993 Sone ..... 400/649
6,474,883 B1 * 11/2002 Kawakami et al. ..... 400/613
7,802,750 B2 9/2010 Takeuchi
2009/0085282 A1 * 4/2009 Yokoyama ..... 271/226
2012/0218354 A1 * 8/2012 Maekawa ..... 347/47

FOREIGN PATENT DOCUMENTS

| | | | |
|---|---|---|---|
| EP | 1780029 | | 5/2007 |
| JP | 07314830 | A * | 12/1995 |
| JP | 08293957 | A * | 11/1996 |
| JP | 10101252 | | 4/1998 |
| JP | 10193740 | | 7/1998 |
| JP | 200180797 | A | 3/2001 |
| JP | 2001158141 | | 6/2001 |
| JP | 3376232 | | 2/2003 |
| JP | 2007076280 | A * | 3/2007 |
| JP | 2007210687 | A * | 8/2007 |
| JP | 2008114983 | | 5/2008 |
| JP | 2009078414 | | 4/2009 |

* cited by examiner

*Primary Examiner* — Daniel J Colilla

(74) *Attorney, Agent, or Firm* — Lowe Hauptman & Ham LLP

(57) ABSTRACT

A printer has a roll paper compartment that stores roll paper so that it can roll on a horizontal axis of rotation, a roll paper cover that pivots to open and close the roll paper compartment, and a tension roller that is displaced when the roll paper cover pivots open and closed. The roll paper compartment is supported to pivot in the direction in which the roll paper cover rotates when the roll paper cover pivots open or closed. The tension roller is disposed to a position where it urges the roll paper opposite the direction in which the roll paper compartment moves circularly when the roll paper cover pivots in the opening direction.

10 Claims, 9 Drawing Sheets

ROLL PAPER PRINTER AND METHOD OF OPENING AND CLOSING A ROLL PAPER PRINTER COVER

RELATED APPLICATIONS

The present application is based on, and claims priority from, Japanese Application Number 2010-075002, filed Mar. 29, 2010, the disclosure of which is hereby incorporated by reference herein in its entirety.

BACKGROUND

1. Technical Field

The present invention relates to a roll paper printer that unrolls and prints on roll paper, and to a method of opening and closing a roll paper printer cover that is opened and closed when loading roll paper.

2. Related Art

Receipt printers and other types of roll paper printers that print on roll paper are commonly used in POS (point-of-sale) systems, for example.

Some roll paper printers of this type have a case with an opening in the front and a front cover that is attached so that it can open and close freely and covers the opening. The roll paper can be loaded and replaced from the front of the printer by opening this front cover. See, for example, Japan Patent No. 3376232, and Japanese Unexamined Patent Appl. Pub. JP-A-2009-78414.

However, because the roll paper is stored inside the case, replacing the roll paper can be troublesome even if the front cover opens.

Removing the roll paper can be made easier in this case by using a configuration that causes the roll paper to move to the front when the front cover is opened, but when the front cover is opened, inertia may cause the roll paper to keep rolling forward when it moves to the front and fall out of the printer.

SUMMARY

A roll paper printer and a method of opening and closing a roll paper printer cover according to the invention facilitate replacing roll paper while also preventing the roll paper from falling out of the printer.

A first aspect of the invention is a roll paper printer including a roll paper storage unit that stores roll paper with the axis of rotation transverse so that the roll paper can roll thereinside; an opening/closing cover that opens and closes the roll paper storage unit by pivoting; and an urging member that is displaced in conjunction with the opening/closing cover pivoting; wherein the roll paper storage unit is supported to pivot in the direction in which the opening/closing cover pivots in conjunction with the opening/closing cover pivoting, and the urging member is disposed to a position urging the roll paper opposite the direction in which the roll paper storage unit pivots while the opening/closing cover pivots open.

Because the roll paper storage unit in this aspect of the invention pivots in the same direction the opening/closing cover pivots, roll paper can be easily removed from and loaded into the roll paper storage unit by opening the opening/closing cover.

In addition, when the opening/closing cover pivots in the opening direction and the roll paper storage unit also rotates, the roll paper stored in the roll paper storage unit is urged by the urging member in the opposite direction as the direction in which the roll paper storage unit is moving. As a result, the urging member can prevent the roll paper, which tends to roll out in the direction of rotation due to inertia from the pivoting action of the roll paper storage unit, from rolling and falling outside.

The roll paper can thus be prevented from rolling out of the roll paper compartment while facilitating replacing the roll paper.

In a roll paper printer according to another aspect of the invention, the urging member urges the roll paper in the direction pushing against the roll paper storage unit.

The urging member in this aspect of the invention pushes and reliably holds the roll paper, which tends to roll out in the direction of rotation due to inertia from the pivoting action of the roll paper storage unit, in the roll paper storage unit. As a result, the roll paper can be more effectively prevented from falling out.

Further preferably, the roll paper printer according to another aspect of the invention also has a supply roller that delivers a web of roll paper stored in the roll paper storage unit; and transportation rollers that are disposed downstream from the supply roller in the transportation direction and hold and convey the roll paper web; and the urging member is a tension roller that is supported on the transportation path from the supply roller to the transportation rollers to maintain constant roll paper tension on the transportation rollers.

With this aspect of the invention the tension roller applies tension to the roll paper and maintains constant tension on the transportation roller, thereby stabilizing paper feed precision. In addition, because the tension roller is the urging member that prevents the roll paper from jumping out of the roll paper compartment, the roll paper can be prevented from dropping out of the roll paper compartment without incurring the additional cost of adding a separate device for the same purpose.

Further preferably in a roll paper printer according to another aspect of the invention, the transportation rollers and tension roller are disposed to a common transportation unit; and the transportation unit moves in the opening direction in conjunction with the opening/closing cover starting to pivot in the opening direction, and moves to a position where the tension roller can contact the roll paper in the roll paper storage unit, and as the opening/closing cover pivots further in the opening direction, the roll paper is urged by the tension roller while the roll paper storage unit continues to pivot.

When the opening/closing cover opens in this aspect of the invention, the transportation unit moves, the tension roller pushes against the roll paper, and the roll paper can be prevented from falling out.

In a roll paper printer according to another aspect of the invention, the urging member is preferably disposed above the end of the roll paper storage unit on the opening/closing cover side when the opening/closing cover is fully open.

If the roll paper starts to roll out in this aspect of the invention, the urging member located above the end of the roll paper storage unit on the opening/closing cover side can reliably prevent the roll paper from rolling out.

A roll paper printer according to another aspect of the invention preferably also has a movement limiting member that moves as a result of the opening/closing cover pivoting and limits movement of the roll paper, is disposed above the roll paper storage unit when the opening/closing cover is closed, and is disposed to a position on the opening/closing cover side of the roll paper storage unit when the opening/closing cover is open.

When the roll paper tries to roll out due to inertia when the opening/closing cover opens, the movement limiting member disposed at a position on the opening/closing cover side of the roll paper storage unit in this aspect of the invention can prevent the roll paper from falling outside.

Another aspect of the invention is a roll paper printer including: a printhead that prints on paper supplied from a paper roll; a roll paper storage unit that is a compartment for accommodating roll paper, and can pivot from a first position to a second position on an axis of rotation that is parallel to the axis of rotation of the paper roll; a tension roller that can contact the roll paper; and a linkage mechanism that can move the tension roller from a third position to a fourth position, and after moving the tension roller on a straight first path from the third position, moves the tension roller on a curved second path to the fourth position. The roll paper storage unit pivots from the first position to the second position while the tension roller moves along the second path. The tension roller is positioned upstream from the printhead in the roll paper transportation direction and applies tension to the paper which is pulled from the paper roll when in the third position. When in the fourth position, the tension roller is positioned with at least part of the tension roller vertically above a horizontal plane that is tangential to the bottom of the paper roll, is positioned in front of the direction in which the paper roll moves as a result of the roll paper storage unit pivoting from the first position to the second position, and contacts the paper roll and pushes the roll in the direction opposite the direction in which the paper roll moves.

In this aspect of the invention the tension roller can preferably contact the paper roll while the roll paper storage unit moves from the first position to the second position.

Further preferably in another aspect of the invention, the tension roller can hold the paper roll between the tension roller and a wall of the roll paper storage unit.

The roll paper printer according to another aspect of the invention preferably also has a cover for opening and closing the roll paper storage unit; the roll paper storage unit pivots in conjunction with the cover opening and closing, is positioned to a first position when the cover is in a closed position, and is positioned to a second position when the cover is in an open position; and the linkage mechanism moves the tension roller in conjunction with the cover opening and closing, and moves the tension roller from the third position to the fourth position when the cover moves from the closed position to the open position.

Another aspect of the invention is a method of opening and closing a cover of a roll paper printer that has a roll paper storage unit that stores roll paper with the axis of rotation transverse so that the roll paper can roll thereinside, and an opening/closing cover that opens and closes the roll paper storage unit by pivoting, wherein: the step of opening the opening/closing cover includes an urging step of urging the roll paper stored in the roll paper storage unit in the opposite direction as the direction in which the opening/closing cover opens by means of an urging member that moves in conjunction with the opening and closing operation of the opening/closing cover when the roll paper storage unit pivots in the direction in which the opening/closing cover opens.

With the opening and closing method according to this aspect of the invention, when the opening/closing cover pivots in the opening direction and the roll paper storage unit also rotates, the urging member urges the roll paper stored in the roll paper storage unit in the opposite direction as the direction in which the roll paper storage unit is moving. As a result, the urging member can prevent the roll paper, which tends to roll out in the direction of rotation due to inertia from the pivoting action of the roll paper storage unit, from rolling and falling outside.

Preferably, the urging step includes an operation of pushing the roll paper to the roll paper storage unit by means of the urging member.

With this method, the urging member pushes and reliably holds the roll paper, which tends to roll out in the direction of rotation due to inertia from the pivoting action of the roll paper storage unit, in the roll paper storage unit. As a result, the roll paper can be more effectively prevented from falling out.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a roll paper printer and a method of opening and closing a roll paper printer cover according to the invention are described below with reference to the accompanying figures.

Figure 1:
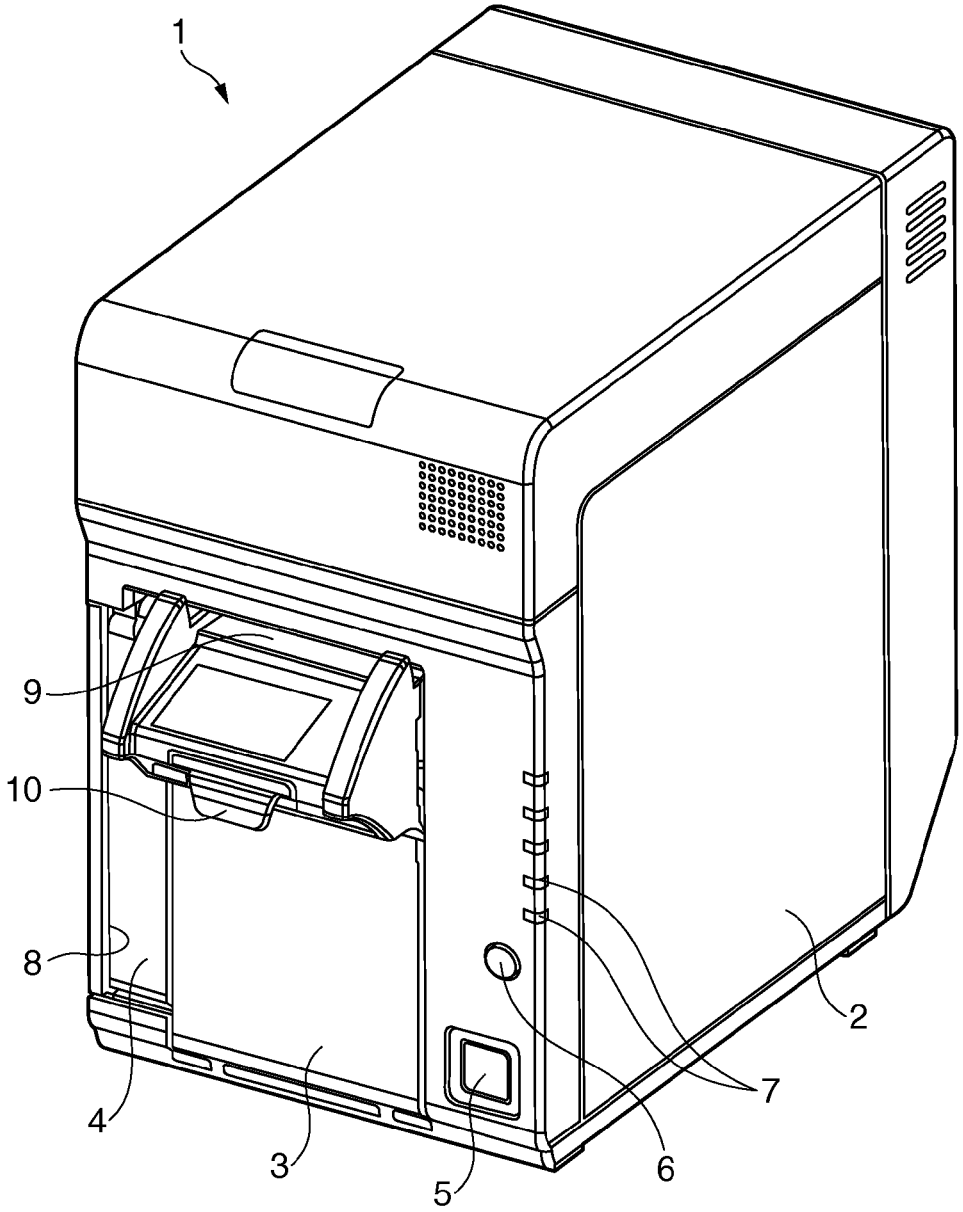
FIG. 1 is an external oblique view of roll paper printer according to a preferred embodiment of the invention.

The inkjet printer 1 shown in FIG. 1 is a roll paper printer that uses plural colors of ink to print in color on the part of the roll paper delivered from the paper roll, and has a roll paper cover (opening/closing cover) 3 disposed so that it can open and close freely in the front center part of the printer case 2 that covers the printer frame. An ink cartridge loading opening 8 is disposed on the left side of the roll paper cover 3, and an ink cartridge 4 can be inserted from this ink cartridge loading opening 8 and stored inside the printer. A power switch 5, feed switch 6, and indicators 7 are also disposed at the front of the printer case 2.

Figure 2:
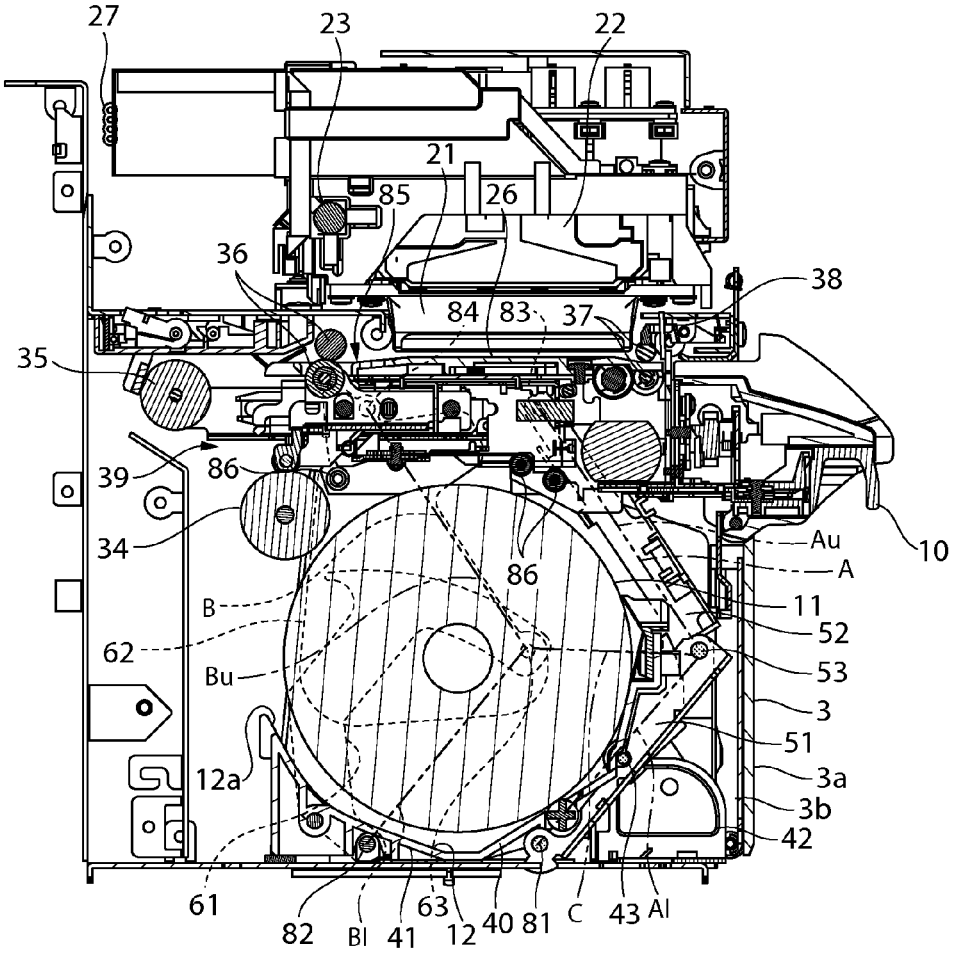
FIG. 2 is a side view of the printer shown in FIG. 1 with the printer case removed.

As shown in FIG. 2, the roll paper 11 used as the print medium is stored in a roll paper compartment 12 (roll paper storage unit). When the roll paper cover 3 is opened, the roll paper compartment 12 is open and the roll paper 11 can be loaded or replaced.

The roll paper cover 3 can pivot on its bottom end. A paper exit 9 from which the roll paper is discharged after printing is rendered at the top of the roll paper cover 3, and a opening/closing slider 10 that can slide to the front is disposed below the paper exit 9.

Figure 3:
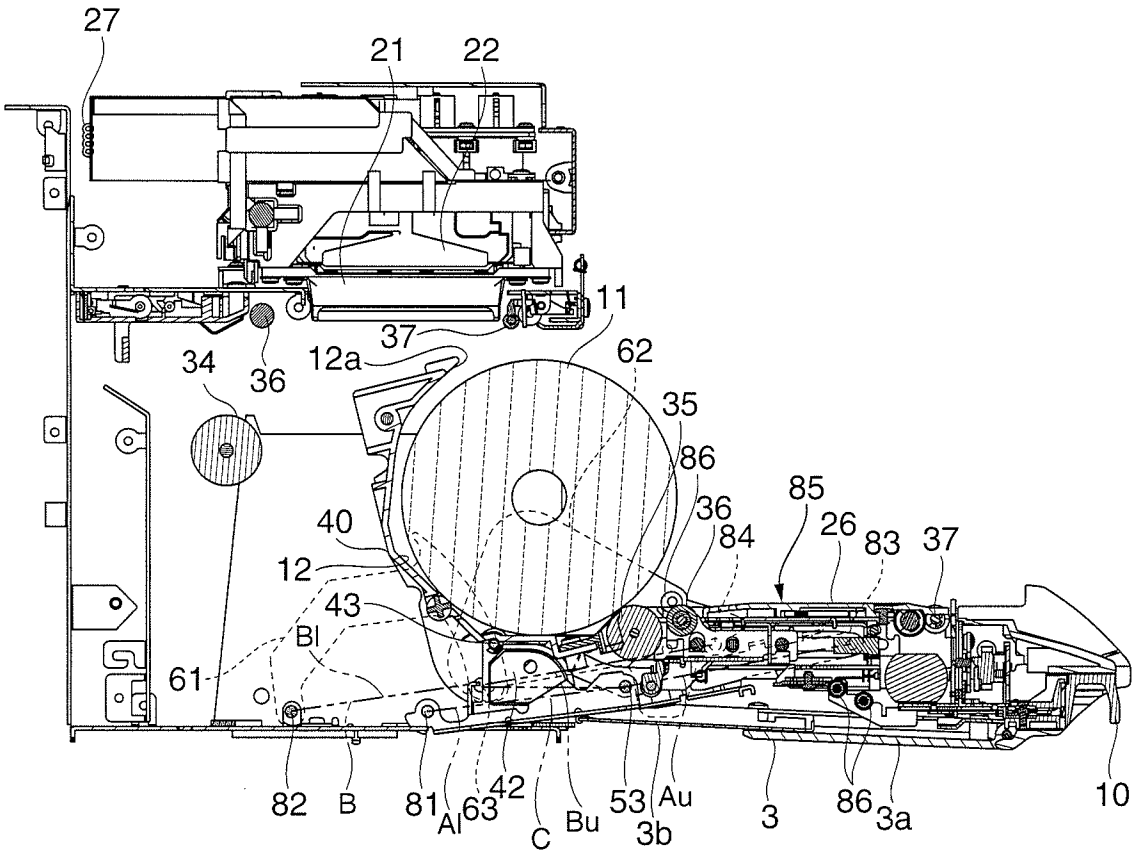
FIG. 3 is a side section view of the printer shown in FIG. 1 with the roll paper cover open.

When the slider 10 is pulled forward (to the front), a lock that holds the roll paper cover 3 in the closed position is released. When the slider 10 is then pulled further forward from this position, the roll paper cover 3 pivots on its bottom end and opens as shown in FIG. 3, thereby exposing the roll paper compartment 12 rendered behind the roll paper cover 3 so that roll paper can be dropped into the roll paper compartment 12.

Figure 4:
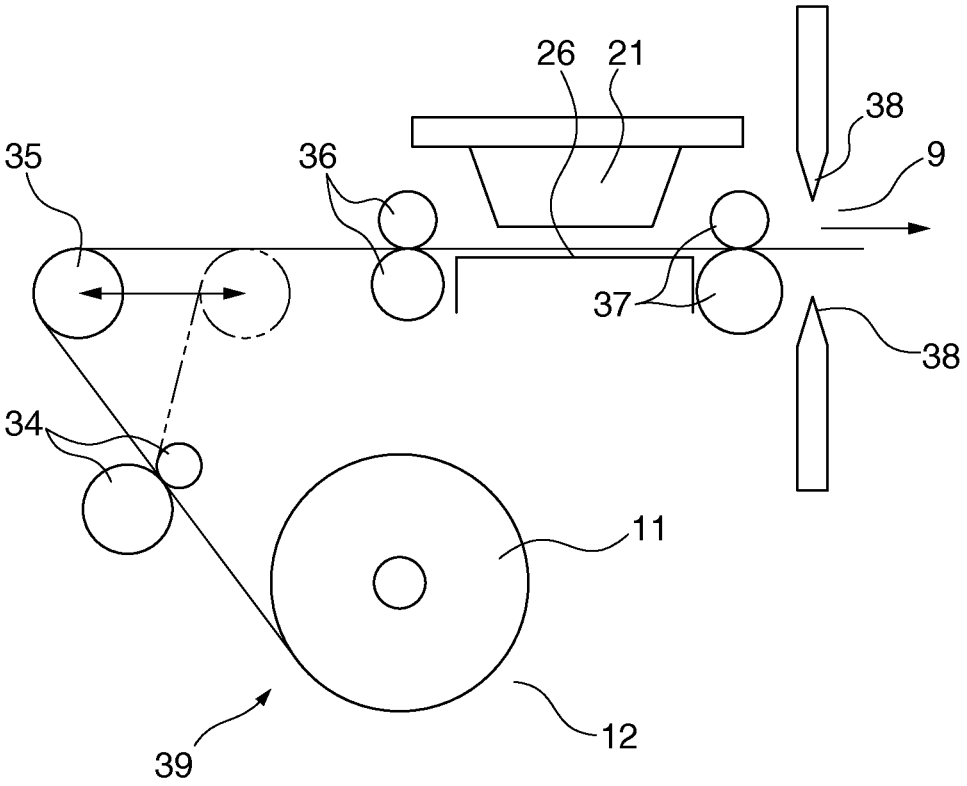
FIG. 4 is a side section view schematically describing the configuration of the paper feed mechanism of the printer shown in FIG. 1.

As shown in FIG. 4, supply rollers 34 for supplying the roll paper 11 stored in the roll paper compartment 12 in a sheet are disposed at the back top part of the roll paper compartment 12. The roll paper 11 is pulled up from the bottom 41 side. A roll paper supply device 39 is configured to pull and supply the roll paper 11 in a sheet from the roll paper compartment 12 and supply rollers 34.

Main feed rollers (transportation rollers) 36 that hold and convey the roll paper 11 therebetween are disposed on the downstream side of the supply rollers 34. A tension roller 35 is also disposed to the transportation path from the supply rollers 34 and main feed rollers 36. The tension roller 35 contacts the part of the roll paper 11 that is pulled from the paper roll by the supply rollers 34, and is urged to the back of the printer (to the upstream side in the transportation direction) to maintain constant roll paper 11 tension on the main feed rollers 36.

Front feed rollers 37 that hold and convey the roll paper 11 therebetween are disposed downstream from the main feed rollers 36, and a platen 26 is disposed between the main feed rollers 36 and front feed rollers 37. A cutter 38 for cutting the printed roll paper 11 is disposed at the paper exit 9.

The roll paper 11 is pulled from the roll paper compartment 12, conveyed passed the supply rollers 34, tension roller 35, main feed rollers 36, platen 26, and front feed rollers 37, and discharged from the paper exit 9. These transportation rollers 34, 36, 37 are driven by a supply motor or paper feed motor through an intervening transmission mechanism using gears or belts and pulleys, for example.

The rotating shafts of the supply rollers 34, tension roller 35, main feed rollers 36, and front feed rollers 37 are parallel to the axis of rotation of the roll paper 11.

The supply rollers 34 unfurl the roll paper 11 stored in the roll paper compartment 12 into a sheet and produce paper feed power. Rotation of the main feed rollers 36 is controlled with high precision so that the main feed rollers 36 convey the roll paper 11 at a precise paper feed pitch. The tension roller 35 stabilizes the paper feed precision by maintaining a constant load on the main feed rollers 36, and enables high speed paper feed by maintaining a constant amount of slack in the roll paper 11.

The front feed rollers 37 are a pair of cylindrical rollers, and feed the roll paper 11 sheet to the paper exit 9 while holding the roll paper 11 therebetween with sufficient clamping force. If the roll paper 11 discharged from the paper exit 9 is pulled in a direction crosswise to the discharge direction (paper feed direction), the clamping force of the front feed rollers 37 prevents the paper from being lifted away from the platen 26, prevents paper jams resulting from the paper lifting off the platen, and thereby enables printing to continue normally with good results.

As shown in FIG. 2, a carriage 22 on which an inkjet head 21 (printhead) is mounted is disposed inside the printer above the roll paper compartment 12. The inkjet head 21 is mounted on the carriage 22 so that the nozzle surface in which the nozzles that discharge ink are formed faces the platen 26. The carriage 22 is supported freely movably widthwise to the paper on a guide member 23 that extends widthwise to the roll paper 11, and is connected to an endless belt (not shown in the figure). A carriage motor that drives this endless belt causes the carriage 22 to travel bidirectionally widthwise to the roll paper 11 above the platen 26.

A flexible ink tube 27 that forms at least part of the ink path that communicates with the ink cartridge is connected to the carriage 22. Ink is supplied through this ink tube 27 from the ink cartridge 4 stored in the ink cartridge storage unit to the inkjet head 21 carried on the carriage 22.

The standby position (home position) of the bidirectionally moving carriage 22 is on one side of the inkjet printer 1. An ink suction mechanism (not shown in the figure) that suctions ink from the nozzles of the inkjet head 21 exposed below the carriage 22 is rendered below this standby position.

The inkjet printer 1 thus prints by discharging ink from the inkjet head 21 mounted on the bidirectionally travelling carriage 22 onto the portion of roll paper 11 delivered from the paper roll.

The roll paper compartment 12 has a roll paper holder 40. The roll paper holder 40 has a plastic bottom 41 that is curved when seen from the side, and the roll paper 11 is placed on the bottom 41. The roll paper 11 is stored in the roll paper compartment 12 so that it can roll with its axis of rotation extending transversely, that is, parallel to the rotational axis of the supply rollers 34.

The roll paper compartment 12 (roll paper holder 40) is pivotably connected by a connection pin 43 to a bracket 42 inside the case 2. The rotational axis of the roll paper compartment 12 is parallel to the rotational axis of the roll paper 11.

A linkage mechanism is disposed at the side of the roll paper compartment 12. This linkage mechanism includes a front compound link A and a back compound link B. The front compound link A includes a first link member 51 and a second link member 52 connected in series by a link pin 53. The back compound link B includes a third link member 61 and a fourth link member 62 connected in series by a link pin 63. The front compound link A includes a first link Au composed of the first link member 51, and a second link Al composed of the second link member 52. The back compound link B includes a third link Bu composed of the third link member 61, and a fourth link Bl composed of the fourth link member 62.

A connecting link member (not shown in the figure) spans between the link pins 53, 63 of the front compound link A and back compound link B, and the front compound link A and back compound link B are thus connected to each other by a connection link C. The linkage mechanism is thus rendered by the front compound link A, back compound link B, and connection link C.

The bottom ends of the front compound link A and back compound link B are each pivotably connected by connection pins 81, 82 to the bottom of the inkjet printer 1. The top ends of the front compound link A and back compound link B are pivotably connected by connection pins 83, 84 to the platen unit (transportation unit) 85, on the distal end of which is disposed the slider 10. The platen unit 85 includes the platen 26, the tension roller 35, and the lower rollers of the main feed roller 36 and front feed roller 37 pairs.

A plurality of guard pins (movement limiting members) 86 are disposed to the platen unit 85 on the roll paper compartment 12 side. Movement of the roll paper 11 to the platen unit 85 side is limited by these guard pins 86, thereby preventing problems resulting from the roll paper 11 interfering with mechanical parts of the platen unit 85.

The roll paper cover 3 has a cover unit 3*a* that is pivotably connected to the platen unit 85, and a frame unit 3*b* that is pivotably connected to the bottom of the inkjet printer 1. The cover unit 3*a* and frame unit 3*b* are connected so that they can slide together, and the roll paper cover 3 can thereby expand and contract.

What happens when the roll paper 11 is stored in the roll paper compartment 12 and the roll paper cover 3 opens is described next.

Figure 5:
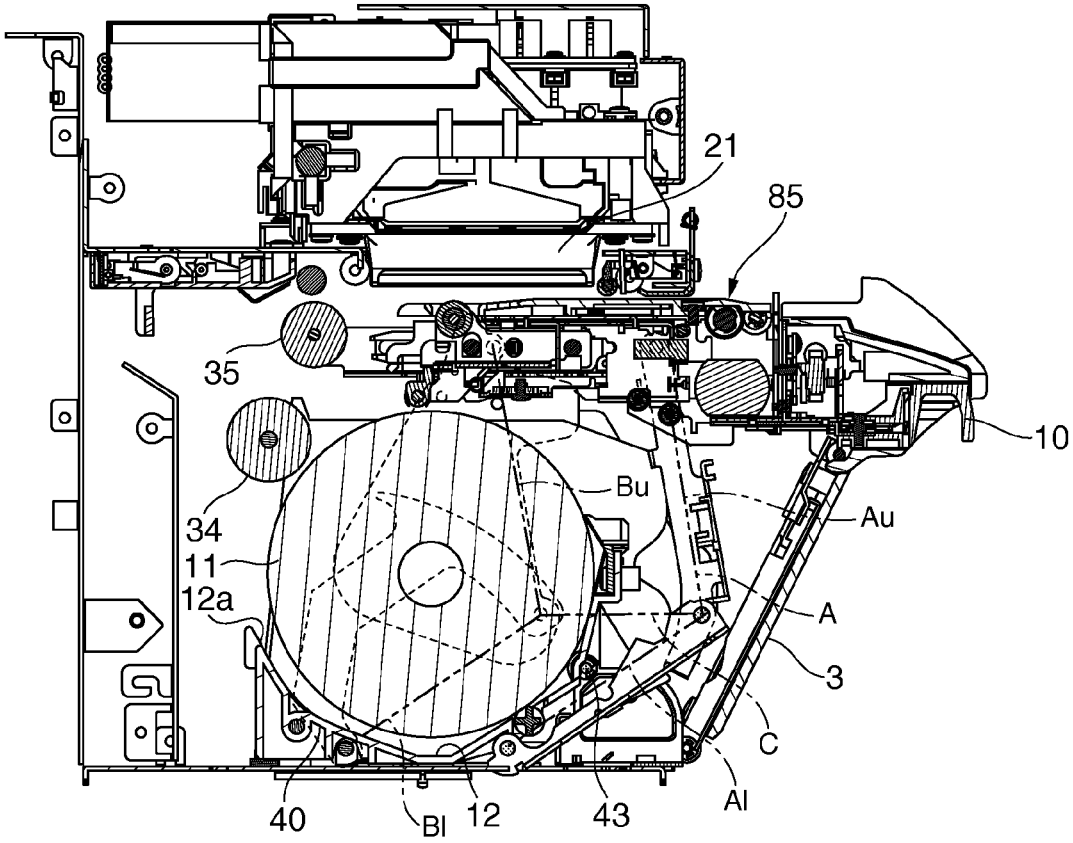
FIG. 5 is a side section view describing the opening action of the roll paper cover of the printer shown in FIG. 1.

When the roll paper cover 3 is in the closed position shown in FIG. 2 and the slider 10 is pulled forward, the slider 10 moves to the front and the lock holding the roll paper cover 3 in the closed position is released. When the slider 10 is then pulled further forward, the roll paper cover 3 rotates open pivoting on the bottom end thereof as shown in FIG. 5, and the platen unit 85 is pulled forward.

Because the platen unit 85 moves straight forward while being held horizontal by the six-node linkage mechanism described above, the platen unit 85 can be pulled to the front without interfering with the inkjet head 21 or roll paper 11. More specifically, the platen unit 85 moves along a linear path by means of this six-node linkage mechanism.

Figure 6:
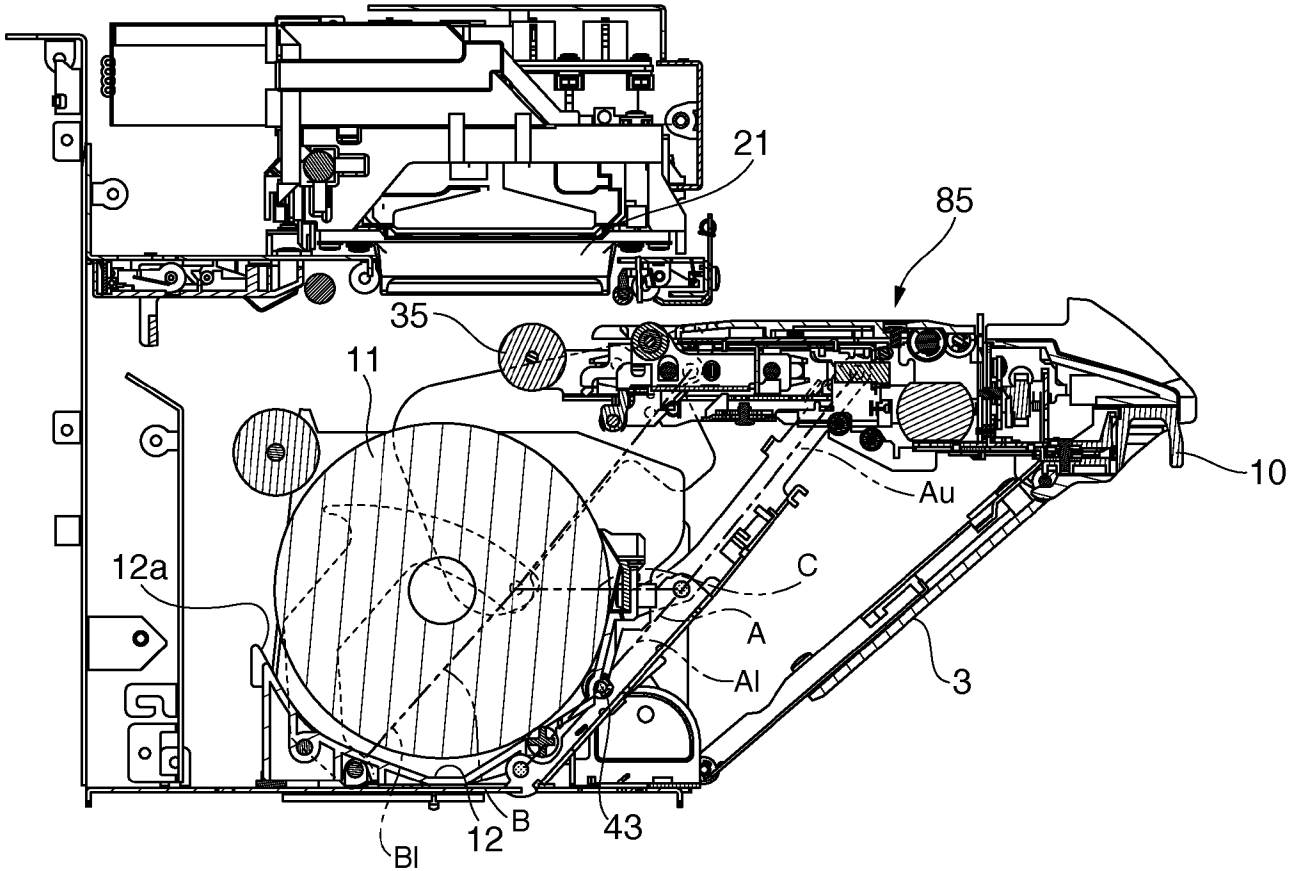
FIG. 6 is a side section view describing the opening action of the roll paper cover of the printer shown in FIG. 1.

When the slider 10 is pulled further forward, the platen unit 85 is pulled straight to the front as shown in FIG. 6, the first link Au and second link Al of the front compound link A of the linkage mechanism become straight, and the third link Bu and fourth link Bl of the back compound link B become straight. As a result, the linkage mechanism becomes a four-node linkage mechanism composed of the straight front compound link A and the straight back compound link B.

When the front compound link A and the back compound link B are fully extended to the maximum linkage length, the resulting four-node linkage mechanism functions as a parallel linkage mechanism in this embodiment of the invention. This parallel linkage mechanism enables the platen unit 85 to remain horizontal while moving along a curved path. As described above, the roll paper cover 3 can also stretch as a result of the cover unit 3*a* and frame unit 3*b* sliding relative to each other.

Figure 7:
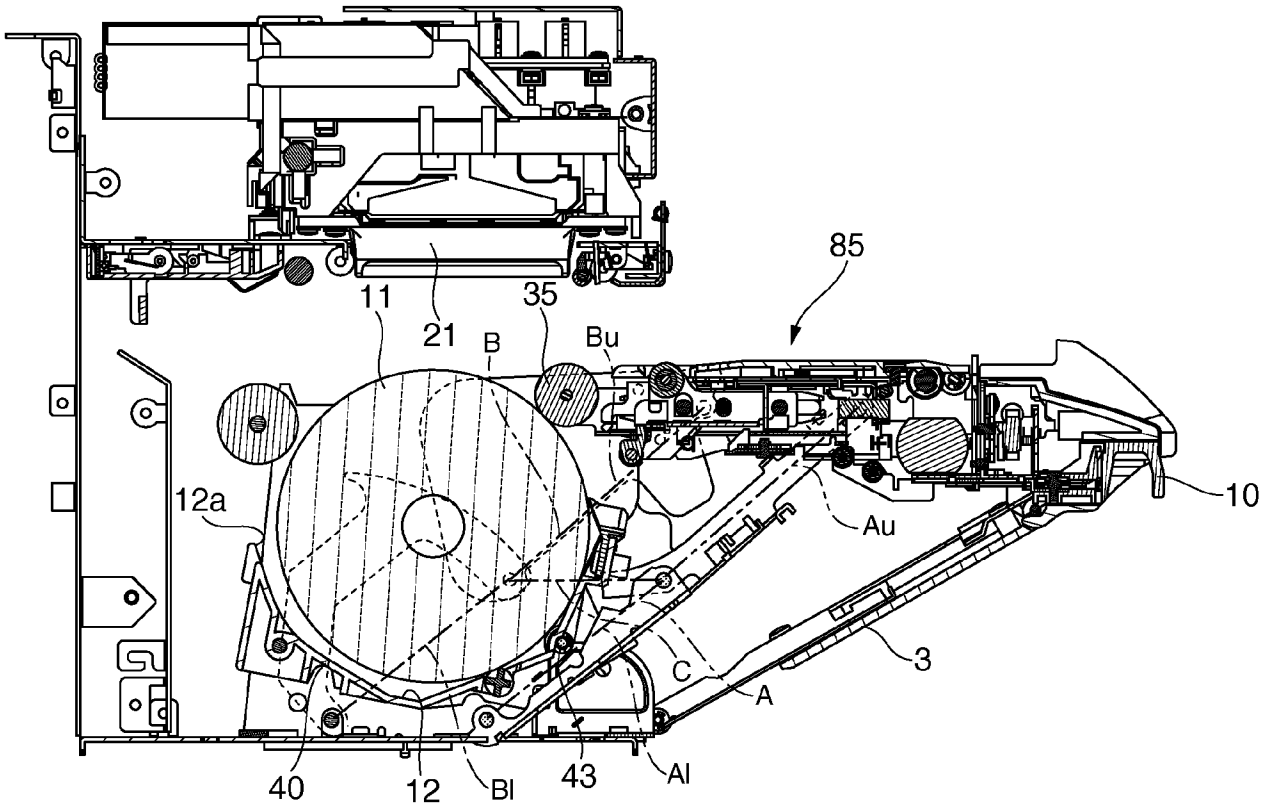
FIG. 7 is a side section view describing the opening action of the roll paper cover of the printer shown in FIG. 1.
Figure 8:
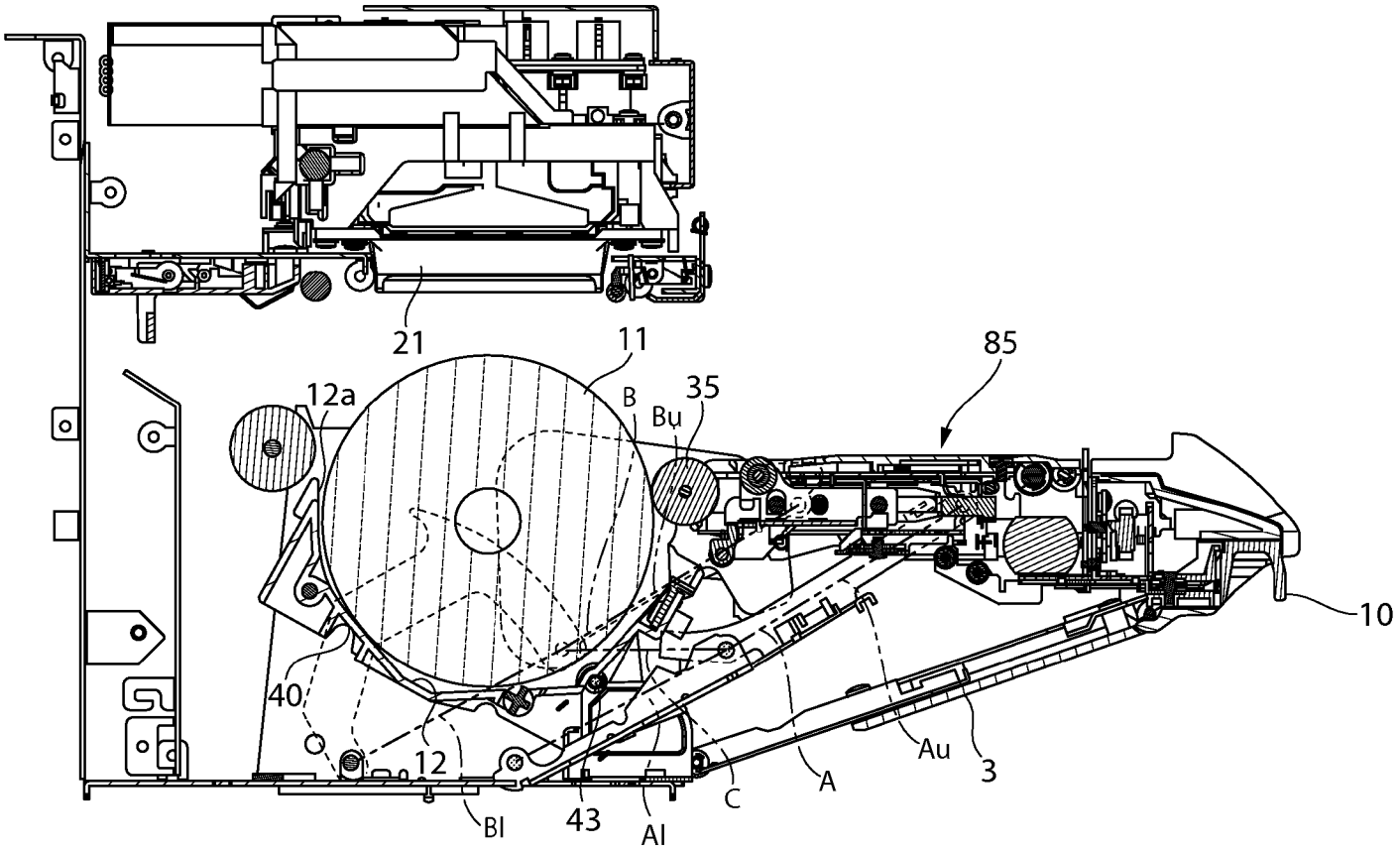
FIG. 8 is a side section view describing the opening action of the roll paper cover of the printer shown in FIG. 1.

When the platen unit 85 swings forward by means of this four-node linkage mechanism, the tension roller 35 protruding from the back end of the platen unit 85 contacts the surface of the roll paper 11 as shown in FIG. 7. When the platen unit 85 moves further from this position, the roll paper compartment 12 (roll paper holder 40) moves circularly with the platen unit 85 by pivoting on the connection to the bracket 42 at the connection pins 43 as shown in FIG. 8.

The tension roller 35, which is in contact with the surface of the roll paper 11 held in the roll paper compartment 12, is pushed toward the platen unit 85 at this time. As a result, the roll paper 11 bears the counterforce from the tension roller 35, and is held in the roll paper compartment 12 between the tension roller 35 and the back end 12*a* (a wall part of the roll paper compartment 12) of the roll paper compartment 12.

Because the roll paper 11 is held so that it can roll freely inside the roll paper compartment 12 and the tension roller 35 is a rotatable roller, the roll paper 11 and tension roller 35 can roll against each other when the roll paper 11 and tension roller 35 are touching, and therefore do not create a load impeding movement of the platen unit 85. The roll paper cover 3 can therefore be opened smoothly.

Figure 9:
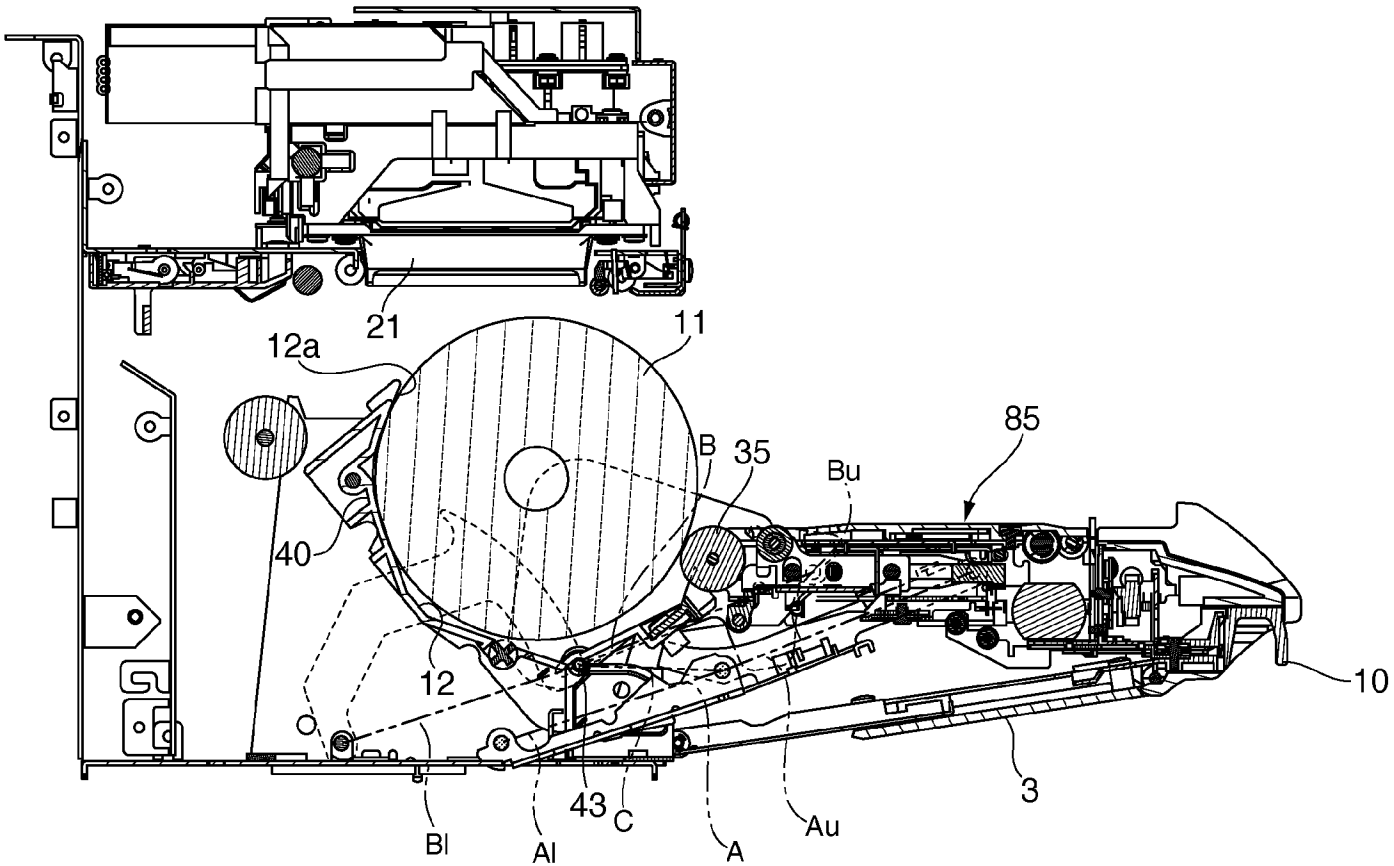
FIG. 9 is a side section view describing the opening action of the roll paper cover of the printer shown in FIG. 1.

When the platen unit 85 moves further forward as shown in FIG. 9, the roll paper compartment 12 also moves rotationally with the roll paper 11 held between the tension roller 35 and the back end 12*a* of the roll paper compartment 12, and the back end 12*a* of the roll paper compartment 12 is positioned above the tension roller 35. The tension roller 35 is thus pushed further toward the platen unit 85 by the roll paper 11.

As a result of the roll paper compartment 12 pivoting on the connection with the bracket 42 at this time, the roll paper 11 moves toward the front of the inkjet printer 1 while being lifted up. As a result, a force urging the roll paper 11 to roll over the platen unit 85 results from the inertia of this motion toward the front of the inkjet printer 1.

However, because the tension roller 35 is disposed to a higher position than the bottom of the roll paper compartment 12 (the lowest part of the roll paper 11), the roll paper 11 is prevented by the tension roller 35 from jumping forward to the platen unit 85 side. In other words, the tension roller 35 is positioned vertically above the (imaginary) horizontal plane tangent to the lowest part of the roll paper 11.

Furthermore, because the tension roller 35 can rotate, the tension roller 35 also rotates if the roll paper 11 attempts to roll over the tension roller 35 due to inertia, and the inertia of the roll paper 11 is cancelled by rotation of the tension roller 35. This also prevents the roll paper 11 from jumping forward.

When the roll paper cover 3 moves to the fully open position shown in FIG. 3, the roll paper compartment 12 pivots on the connection with the bracket 42 and the roll paper 11 moves further to the front of the inkjet printer 1. The platen unit 85 is also positioned at the lowest position, the tension roller 35 is positioned below the roll paper 11 and held at a retracted position, and the front of the roll paper compartment 12 is open wide. As a result, the roll paper 11 can be easily removed from the roll paper compartment 12, and roll paper 11 can be easily loaded into the roll paper compartment 12.

The roll paper 11 is also released from the tension roller 35 and the back end 12*a* of the roll paper compartment 12 at this time. Even if the roll paper 11 tries to roll due to the inertia of motion to the front of the inkjet printer 1 at this time, the tension roller 35 is at a position higher than the bottom of the roll paper compartment 12 (the lowest part of the roll paper 11), and the inertial force of the roll paper 11 is cancelled by the tension roller 35 also rolling. The roll paper 11 is thus prevented from jumping out. Note that as shown in FIG. 3 the tension roller 35 is positioned so that at least part of the roller (the top part) is vertically above the (imaginary) horizontal plane tangent to the lowest point of the roll paper 11.

One of the guard pins 86 is also disposed protruding up between the platen unit 85 and tension roller 35 at this time. This guard pin 86 therefore also prevents the roll paper 11 from rolling forward.

As described above, because the roll paper compartment 12 also pivots in the same direction as the roll paper cover 3 with the roll paper printer and the method of opening and closing a cover to the roll paper printer according to this embodiment of the invention, roll paper 11 can be easily removed from and loaded into the roll paper compartment 12 by opening the roll paper cover 3.

In addition, when the roll paper cover 3 pivots in the opening direction and the roll paper compartment 12 rotates, the roll paper 11 stored in the roll paper compartment 12 is urged by the tension roller 35 in the opposite direction as the direction in which the roll paper compartment 12 rotates. As a result, the tension roller 35 can prevent the roll paper 11 from rolling forward in the direction the roll paper compartment 12 rotates and falling out due to inertia.

In order to minimize the height of the inkjet printer 1, the position of the roll paper 11 relative to the external height of the printer must be as low as possible when the roll paper cover 3 is closed. However, in order to facilitate loading and unloading the roll paper 11, the roll paper 11 is preferably raised to near the top surface of the platen unit 85 when the roll paper cover 3 is open.

More specifically, because of demand to use more complex mechanisms for the platen unit 85 in order to achieve higher printing speeds, platen unit 85 thickness tends to increase, making raising the position of the roll paper 11 when the roll paper cover 3 is open even more desirable. However, if the roll paper 11 is raised to a high position when the roll paper cover 3 is open, the roll paper 11 may easily roll outside due to inertia.

Even in such configurations, however, the inkjet printer 1 according to this embodiment of the invention can by means of the tension roller 35 reliably prevent the roll paper 11 from jumping out of the printer. More specifically, replacing the roll paper 11 is made easier and a compact device size can be achieved while preventing the roll paper 11 from falling outside.

More particularly, as the roll paper compartment 12 rotates open, the tension roller 35 pushes the roll paper 11 that tends to roll forward and out due to inertia against the back end 12*a* of the roll paper compartment 12 so that roll paper 11 is held firmly between the tension roller 35 and the back end 12*a*, and the roll paper 11 is effectively prevented from falling out.

In addition, because the tension roller 35 that applies tension to the roll paper 11 to maintain constant tension on the main feed rollers 36 and stabilize paper feed precision is also used as an urging member that prevents the roll paper 11 from falling outside, the roll paper 11 can be prevented from rolling outside without incurring the increased cost of adding and using a separate construction for the same purpose.

Yet further, because the tension roller 35 is located above the end of the roll paper compartment 12 on the roll paper cover 3 side when the roll paper cover 3 is fully open, the roll paper 11 cannot drop to the outside without moving over the tension roller 35. The roll paper 11 can therefore be reliably prevented from falling out even when the roll paper cover 3 is fully open.

Yet further, even if the roll paper 11 wants to roll forward due to inertia when the roll paper cover 3 is open, the roll paper 11 is prevented from dropping forward by the guard pin 86 disposed on the roll paper cover 3 side of the roll paper compartment 12.

Furthermore, because the tension roller 35 is located above the end of the roll paper compartment 12 on the roll paper cover 3 side, and a guard pin 86 is disposed on the roll paper cover 3 side of the roll paper compartment 12, when the roll paper cover 3 is open, even roll paper 11 with a small diameter can be reliably prevented from falling out.

Furthermore, as described above, the tension roller 35 is disposed to the platen unit 85 and moves with the platen unit 85, and after moving horizontally along a straight path by means of the six-node linkage mechanism, moves vertically downward along a curved path by means of the four-node linkage mechanism.

The medium used as a print medium in the foregoing embodiment is not specifically limited, and film, cloth, and metal foil, for example, may be used.

The inkjet printer according to the foregoing embodiment of the invention may also be rendered with some of the functions or mechanisms of a computer, a CRT or other display device, input devices, a floppy disk drive, or a CD-ROM drive, for example. The printer may be configured with an image processing unit for image processing, a display unit for displaying information, and a recording medium drive for using recording media storing image data captured by digital cameras, for example.

A computer system including the printer according to the invention, a computer, a CRT or other display unit, a mouse, keyboard, or other input device, a floppy disk drive, and a CD-ROM drive will also be a system that is superior to conventional computer systems.

A color inkjet printer is used as the printer in the foregoing embodiments, but the invention is not so limited and can be applied to any printing device that can print on roll paper, including monochrome inkjet printers, laser printers, thermal printers, and facsimile machines.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A roll paper printer comprising:

a roll paper storage unit that stores roll paper with an axis of rotation so that the roll paper can roll thereinside;

an opening/closing cover that opens and closes the roll paper storage unit by pivoting;

an urging member that is displaced in conjunction with the opening/closing cover pivoting;

a supply roller that delivers a web of roll paper stored in the roll paper storage unit; and transportation rollers that are disposed downstream from the supply roller in the transportation direction and hold and convey the roll paper web;

wherein the roll paper storage unit is supported to pivot in the direction in which the opening/closing cover pivots in conjunction with the opening/closing cover pivoting, wherein the urging member is disposed to a position such that it contacts the roll paper such that the roll paper is guided so that it does not move from the roll paper storage unit while the opening/closing cover pivots open when the roll paper is in contact with the urging member, wherein the urging member is a tension roller that is supported to be on the transportation path to maintain constant roll paper tension on the transportation rollers, wherein the transportation rollers and tension roller are disposed to a common transportation unit, and wherein the transportation unit moves in the opening direction in conjunction with the opening/closing cover starting to pivot in the opening direction, and moves to a position where the tension roller can contact the roll paper in the roll paper storage unit, and as the opening/closing cover pivots further in the opening direction, the roll paper is urged by the tension roller while the roll paper storage unit continues to pivot.

2. The roll paper printer described in claim 1, wherein:

the urging member results in a pressure against the roll paper storage unit, thereby guiding movement of the roll paper.

3. The roll paper printer described in claim 1, wherein:

the urging member is disposed above an end of the roll paper storage unit on the opening/closing cover side when the opening/closing cover is fully open.

4. The roll paper printer described in claim 1, further comprising:

a movement limiting member that moves as a result of the opening/closing cover pivoting and limits movement of the roll paper, is disposed above the roll paper storage unit when the opening/closing cover is closed, and is disposed to a position on the opening/closing cover side of the roll paper storage unit when the opening/closing cover is open.

5. The roll paper printer described in claim 1, wherein:

the roll paper printer is configured such that the urging member contacts the roll paper when the roll paper is located in the roll paper storage unit at at least substantially the same location that the urging member contacts the roll paper when the roll paper is located in the printer during normal use.

6. A roll paper printer comprising:

a printhead that prints on paper supplied from a paper roll;

a roll paper storage unit that is a compartment for accommodating roll paper, and can pivot from a first position to a second position on an axis of rotation that is parallel to the axis of rotation of the paper roll;

a tension roller that can contact the roll paper; and a linkage mechanism that can move the tension roller from a third position to a fourth position, and after moving the tension roller on a straight first path from the third position, moves the tension roller on a curved second path to the fourth position;

wherein the roll paper storage unit pivots from the first position to the second position while the tension roller moves along the second path, and the tension roller is positioned upstream from the printhead in the roll paper transportation direction and applies tension to the paper which is pulled from the paper roll when in the third position, and when in the fourth position, the tension roller is positioned with at least part of the tension roller vertically above a horizontal plane that is tangential to the bottom of the paper roll, is positioned in front of the direction in which the paper roll moves as a result of the roll paper storage unit pivoting from the first position to the second position, and contacts the paper roll and blocks the paper roll from movement in at least one direction.

7. The roll paper printer described in claim 6, wherein:

the tension roller can contact the paper roll while the roll paper storage unit moves from the first position to the second position.

8. The roll paper printer described in claim 7, wherein:

the tension roller can hold the paper roll between the tension roller and a wall of the roll paper storage unit.

9. The roll paper printer described in claim 6, further comprising:

a cover for opening and closing the roll paper storage unit;

wherein the roll paper storage unit pivots in conjunction with the cover opening and closing, is positioned to a first position when the cover is in a closed position, and is positioned to a second position when the cover is in an open position; and the linkage mechanism moves the tension roller in conjunction with the cover opening and closing, and moves the tension roller from the third position to the fourth position when the cover moves from the closed position to the open position.

10. The roll paper printer described in claim 6, wherein:

the roll paper printer is configured such that the tension roller contacts the roll paper when the roll paper is located in the roll paper storage unit at at least substantially the same location that the tension roller contacts the roll paper when the roll paper is located in the printer during normal use.

* * * * *